US005727534A

United States Patent [19]

Kondo et al.

[11] Patent Number: 5,727,534

[45] Date of Patent: *Mar. 17, 1998

[54] MISFIRE DETECTING DEVICE FOR MULTI-CYLINDER INTERNAL COMBUSTION ENGINE

[75] Inventors: Noriaki Kondo, Kasugai; Hiroshi Inagaki, Komaki, both of Japan

[73] Assignee: NGK Spark Plug Co., Ltd., Nagoya, Japan

[ * ] Notice: The term of this patent shall not extend beyond the expiration date of Pat. No. 5,503,132.

[21] Appl. No.: 570,972

[22] Filed: Dec. 12, 1995

[30] Foreign Application Priority Data

Dec. 12, 1994 [JP] Japan ..... 6-307671

[51] Int. Cl.[6] ..... F02P 17/12

[52] U.S. Cl. ..... 123/635; 123/640; 123/647; 324/399

[58] Field of Search ..... 123/635, 647, 123/640, 643, 630; 324/399; 73/116, 117.3

[56] References Cited

U.S. PATENT DOCUMENTS 5,239,973 8/1993 Murata et al. ..... 123/635

5,503,132 4/1996 Miyata et al. ..... 123/630

*Primary Examiner*—Andrew M. Dolinar

*Attorney, Agent, or Firm*—Foley & Lardner

[57] ABSTRACT

A misfire detecting device for a multi-cylinder internal combustion engine is provided. The misfire detecting device comprises high voltage pulse producing means for producing, after spark discharge of a spark plug, a high voltage pulse which is not so high as to cause the spark plug to discharge, voltage applying means for applying the high voltage pulse to a conductive path connecting between the secondary winding of the ignition coil to the spark plug, by way of a reverse current preventing diode and a leakage preventing diode for preventing intrusion of the high voltage for ignition, voltage dividing means for dividing a voltage at the junction between the reverse current preventing diode and the leakage preventing diode to obtain a divided voltage thereat, and misfire detecting means for detecting a misfire on the basis of a decay characteristic of the divided voltage obtained after application of the high voltage pulse. The high voltage pulse producing means, the voltage applying means, the voltage dividing means and the combustion condition detecting means are housed within a case having a pair of terminals connectable directly and in series to the conductive path and having disposed therewithin a conductive line connecting between the terminals. The voltage applying means applies the high voltage pulse to the conductive line.

6 Claims, 4 Drawing Sheets

MISFIRE DETECTING DEVICE FOR MULTI-CYLINDER INTERNAL COMBUSTION ENGINE

BACKGROUND OF THE INVENTION

1. Field of the Invention

The present invention relates to a misfire detecting device for detecting a combustion condition or misfire of each cylinder of a multi-cylinder internal combustion engine.

2. Description of the Prior Art

Various ignition systems for use in multi-cylinder internal combustion engines are known, for example, as shown in FIG. 4A, there is known a distributor type ignition system which includes an ignition coil 50, a power transistor 52 for making a battery current flow through a primary winding 50*a* of the ignition coil 50, an engine control unit (ECU) 54 for driving the power transistor 52 in sequence and in timed relation to the ignition timings of each cylinder #1~#4 and inducing a high voltage for ignition in a secondary winding 50*b* of the ignition coil 50, and a distributor 55 for distributing the high voltage for ignition to spark plugs 56~59 of the respective cylinders #1~#4 of the internal combustion engine sequentially, whereby the ignition system is adapted to distribute the high voltage for ignition to each spark plug by way of the distributor 55.

As shown in FIG. 4B, there is further known a single-ended distributorless ignition system which includes a plurality of ignition coils 61 and 62 corresponding to each cylinder #1 and #2 of an internal combustion engine, power transistors 64 and 65 for making a battery current flow through primary windings 61*a* and 62*a* of the ignition coils 61 and 62, and an engine control unit (ECU) 67 for driving the power transistors 64 and 65 one by one and in timed relation to the ignition timings of each cylinder #1 and #2 and inducing a high voltage for ignition in secondary windings 61*b* and 62*b* of the ignition coils 61 and 62, whereby the ignition system is adapted to apply a high voltage for ignition produced at each secondary windings 61*b* and 62*b* directly to each spark plug 68 and 69.

Though not shown, there is further known a double-ended distributorless ignition system which is constructed so as to make a secondary winding of an ignition coil be connected at opposite ends thereof to a pair of spark plugs provided to different cylinders and thereby be capable of applying a high voltage for ignition from one ignition coil to two spark plugs simultaneously.

In each of such ignition systems, there is normally incorporated a combustion condition or misfire detecting device which is adapted to detect a combustion condition or misfire of each cylinder of an internal combustion engine on the basis of a waveform of a voltage obtained after spark discharge of the spark plug.

For example, the distributor type ignition system shown in FIG. 4A is provided with a misfire detecting device which consists of coupling capacitors 71~74 of a small capacity, disposed in a conductive path for applying a high voltage for ignition to the spark plugs 56~59, a voltage dividing circuit 78 made up of a capacitor 76 of a relatively large capacity, grounded at one end and a resistor 77, and a misfire detecting circuit 80 for detecting a misfire of each cylinder #1 ~#4 on the basis of a decay characteristic of a divided voltage which is obtained by means of the voltage dividing circuit 78 after firing of each cylinder #1~#4. Further, the single-ended distributorless ignition system is provided with a misfire detecting device which consists of capacitors 81 and 82 of a small capacity, a voltage dividing circuit made up of a capacitor 84 of a relatively large capacity and a resistor 85, and a misfire detecting circuit 87 for detecting a misfire of each cylinder #1 and #2 on the basis of a decay characteristic of a divided voltage obtained by means of the voltage dividing circuit.

However, in the prior art misfire detecting device, the coupling capacitor of a small capacity, constituting part of the voltage dividing circuit, is directly provided to a conductive path (i.e., high tension code) for each spark plug, to which a high voltage for ignition is applied, in order to detect a voltage waveform obtained after spark discharge. Accordingly, it requires coupling capacitors, each of which is of a high withstand voltage and expensive as it goes, by the number corresponding to that of cylinders, thus causing a problem of a high cost. Further, in order to fix the coupling capacitors to the conductive paths (i.e., high tension codes) for the spark plugs, a fixing device only for that end is necessitated. In this connection, a plurality of such fixing devices corresponding in number to the cylinders are in effect necessitated, thus causing a problem of a high cost and a difficult assembling work.

Further, in the double-ended distributorless ignition system in which a high voltage for ignition is applied from one ignition coil to two spark plugs simultaneously, a negative voltage is applied as a high voltage for ignition to one of the two spark plugs. In the spark plug to which a negative voltage is applied, an electrical resistance between the center electrode and the outer electrode is maintained high even in the case where normal combustion takes place, similarly to the case where a misfire has occurred, so there is caused a problem that it is impossible to correctly distinguish between normal combustion and misfire on the basis of the voltage waveform.

SUMMARY OF THE INVENTION

According to an aspect of the present invention, there is provided a novel and improved misfire detecting device for a multi-cylinder internal combustion engine. The engine has an ignition system for interrupting flow of primary current through a primary winding of an ignition coil and thereby inducing a high voltage for ignition in a secondary winding, and applying the high voltage for ignition to a spark plug provided to each cylinder of the multi-cylinder internal combustion engine. The misfire detecting device comprises high voltage pulse producing means for producing, after spark discharge of the spark plug, a high voltage pulse which is not so high as to cause the spark plug to discharge, voltage applying means for applying the high voltage pulse to a conductive path connecting between the secondary winding of the ignition coil to the spark plug, by way of a reverse current preventing diode and a leakage preventing diode for preventing intrusion of the high voltage for ignition, voltage dividing means for dividing a voltage at the junction between the reverse current preventing diode and the leakage preventing diode to obtain a divided voltage thereat, and misfire detecting means for detecting a misfire on the basis of a decay characteristic of the divided voltage obtained after application of the high voltage pulse, wherein the high voltage pulse producing means, the voltage applying means, the voltage dividing means and the combustion condition detecting means are housed within a case having a pair of terminals connectable directly and in series to the conductive path and having disposed therewithin a conductive line connecting between the terminals, and the voltage applying means applies the high voltage pulse to the conductive line. In the above misfire detecting device, the high voltage pulse producing means produces, after spark discharge of a spark plug, a high voltage pulse which is not so high as to cause the spark plug to discharge. The voltage applying means applies the high voltage pulse to the conductive path connecting between the secondary winding of the ignition coil and the spark plug by way of the reverse current preventing diode and the leakage preventing diode for preventing intrusion of the high voltage for ignition. The voltage dividing means divides the voltage at the junction between the reverse current preventing diode and the leakage preventing diode. The misfire detecting means detects a misfire of the internal combustion engine on the basis of a decay characteristic of a divided voltage obtained at the voltage dividing means. When normal combustion has taken place within a cylinder, the resistance between the center electrode and the outer electrode of the spark plug becomes low. On the other hand, when a misfire has occurred, the resistance between the center electrode and the outer electrode of the spark plug is maintained high. Thus, according to this invention, by applying a high voltage pulse to the conductive path connecting between the secondary winding of the ignition coil and the spark plug and thereby storing a charge in the conductive path, judgment on a misfire of the internal combustion engine can be made on the basis of the decay characteristic of the terminal voltage of the reverse current preventing diode (the divided voltage decays rapidly at the time of normal combustion and slowly at the time of misfire), resulting when the stored charge is discharged through the center electrode of the spark plug to cause the terminal voltage of the reverse current preventing diode to decay. The terminal voltage is caused to decay when the stored charge is discharged through the center electrode of the spark plug, i.e., the divided voltage decays rapidly when normal combustion has taken place, whereas the divided voltage decays slowly when a misfire has occurred. And, according to the present invention, various means for detection of a misfire, i.e., the high voltage pulse producing means, the voltage applying means, the voltage dividing means and the misfire detecting means are housed within the case having a pair of terminals connectable directly and in series to the conductive path and having disposed therewithin a conductive line connecting between the terminals. The voltage applying means applies the high voltage pulse to the conductive line. Thus, according to the present invention, attachment of the misfire detecting device to the ignition system of the internal combustion engine can be attained by only dividing the high tension code for application of a high voltage for ignition to a spark plug into two sections, i.e., a spark plug side section and an ignition coil side section, and connecting the ends of each code section to the terminals of the case, so that attachment of the misfire detecting device can be attained with ease. Further, the high voltage pulse for detection of misfire is applied, within the case, to the conductive line or wire connecting between the ignition coil side high tension code section and the spark plug side high tension code section, so the path for application of the high voltage pulse can be exactly short and therefore a variation of the capacity-to-ground of the path depending upon a variation of the environment in which it is used, never occurs. Due to this, accurate detection of misfire of each cylinder of an internal combustion engine can be attained at all times. Further, in such a misfire detecting device of this invention, all of the circuit therefor, including a conductive line or wire for application of a high voltage pulse is housed within a single case, so a failure such as disconnection at a connected or coupled portion and disruption of diode is hard to occur and even if a failure is caused discharge to the outside of the case can be prevented, thus making it possible to improve the reliability of the misfire detecting device. Further, by mixing an electromagnetic absorber such as ferrite into a material from which the case is formed or by embedding a metal plate in the wall of the case for thereby making the case have an electromagnetic wave shielding ability, it becomes possible to prevent noise generating from the conductive line or wire, etc. at the time of application of the high voltage pulse for thereby preventing a noise interference from being caused by that noise. Further, since attachment or detachment of the misfire detecting device to or from the ignition system can be done together with the case, so a periodical inspection or maintenance can be done with ease and its maintenance ability can be improved. Further, since the misfire detecting device and the ignition system can be connected by means of high tension codes, it becomes possible to attach the misfire detecting device to conventional ignition systems with ease. Furthermore, in such a case, it is not necessary to make any alteration to the structure of itself of the ignition system, thus making it possible to improve the design freedom of the ignition system and the misfire detecting device.

According to another aspect of the present invention, the misfire detecting device further comprises second voltage applying means for applying the high voltage pulse to a second conductive path connecting between a secondary winding of a second ignition coil and another spark plug of the engine, by way of a second reverse current preventing diode and a second leakage preventing diode for preventing intrusion of the high voltage for ignition, and second voltage dividing means for dividing a voltage at the junction between the second reverse current preventing diode and the second leakage preventing diode to obtain a second divided voltage thereat. The misfire detecting means is operative to detect a misfire on the basis of a decay characteristic of the second divided voltage after application of the high voltage pulse. The case has a second pair of terminals connectable directly and in series to the second conductive path and having disposed therewithin a second conductive line connecting between the second pair of terminals. The second voltage applying means and the second voltage dividing means are housed within the case. In this misfire detecting device, the case has a plurality of terminals connectable in series to a plurality of conductive paths, respectively and has a plurality of conductive lines or wires connecting between the terminals, respectively. Within the case, the high voltage pulse producing means, a plurality of voltage applying means for applying a high voltage pulse to the respective conductive lines, a plurality of voltage dividing means, and the misfire detecting means for detecting a misfire of the internal combustion engine on the basis of a divided voltage. Thus, according to the present invention, it becomes unnecessary to attach the misfire detecting device to each of a plurality of conductive paths (high tension codes) for applying a high voltage for ignition to the spark plugs, independently, and attachment of the misfire detecting device to the conductive paths can be attained with ease. Further, it becomes possible to collect misfire detecting device sections for each cylinder within a case, thus making it possible to make the misfire detecting device compact in size. Further, the high voltage pulse producing means and the misfire detecting means can be used commonly, thus making it possible to simplify the device and reduce the cost.

According to a further aspect of the present invention, the voltage dividing means comprises a capacitor voltage dividing circuit including a capacitor of a small capacity connected at one end thereof to the reverse current preventing diode and a capacitor of a relatively large capacity grounded at one end and connected in series to the capacitor of a small capacity. By this misfire detecting device, the voltage at the spark plug side terminal of the reverse current preventing diode can be held within an allowable input range of the misfire detecting device.

According to a further aspect of the present invention, there is provided another kind of misfire detecting device for a multi-cylinder internal combustion engine having an ignition system for interrupting flow of primary current through a primary winding of an ignition coil and thereby inducing a high voltage for ignition in a secondary winding, and applying the high voltage for ignition to a spark plug provided to each cylinder of the multi-cylinder internal combustion engine, the misfire detecting device comprising high voltage pulse producing means for producing, after spark discharge of the spark plug, a high voltage pulse which is not so high as to cause the spark plug to discharge, voltage applying means for applying the high voltage pulse to a conductive path connecting between the secondary winding of the ignition coil and the spark plug, by way of a first path having a reverse current preventing diode and a leakage preventing diode for preventing intrusion of the high voltage for ignition or a second path having the reverse current preventing diode and the secondary winding of the ignition coil, voltage dividing means for dividing a voltage at the junction between the reverse current preventing diode and the leakage preventing diode to obtain a divided voltage thereat, and misfire detecting means for detecting a misfire on the basis of a decay characteristic of the divided voltage obtained after application of the high voltage pulse, wherein the high voltage pulse producing means, the voltage applying means, the voltage dividing means and the misfire detecting means are housed within a case for the ignition coil. In this misfire detecting device, the high voltage pulse producing means, the voltage applying means, the voltage dividing means, and the combustion condition detecting means are housed within a case for the ignition coil. By this device, though a design alteration of the ignition coil is necessitated, the accuracy of detection of misfire, and the reliability and the maintenance ability of the device can be improved. Further, since this misfire detecting device is housed within the case for the ignition coil, a high voltage pulse can be applied to one end of the secondary winding of the ignition coil to which a spark plug is not connected, at the time when a high voltage pulse is applied from the voltage applying means to the igniting line, provided that the ignition system is of the distributor type as shown in FIG. 4A or of the single-ended distributorless type as shown in FIG. 4B in which the ignition coil is connected at opposite ends thereof to spark plugs. In this instance, it becomes possible to eliminate a leakage preventing diode which is otherwise necessitated in the case where a high voltage pulse is directly applied to a conductive path connecting between the ignition coil and the spark plug. Further, in a distributor type ignition system, a high voltage for ignition produced by the ignition coil is distributed to each cylinders by way of a distributor, so in the case where the present invention is applied to a distributor type ignition system, one misfire detecting device can be used commonly for each cylinders, thus making it possible to reduce the number of constituent parts and the cost.

According to a further aspect of the present invention, the ignition system for the multi-cylinder internal combustion engine to which the above described other kind of misfire detecting device is provided is a distributorless type and further has a second ignition coil. The misfire detecting device further comprises second voltage applying means for applying the high voltage pulse to a second conductive path connecting between a secondary winding of the second ignition coil and another spark plug of the engine, by way of a first path having a second reverse current preventing diode and a second leakage preventing diode for preventing intrusion of the high voltage for ignition or a second path having the second reverse current preventing diode and the secondary winding of the second ignition coil, and second voltage dividing means for dividing a voltage at the junction between the second reverse current preventing diode and the second leakage preventing diode to obtain a second divided voltage thereat. The misfire detecting means is operative to detect a misfire on the basis of a decay characteristic of the second divided voltage after application of the high voltage pulse. The second ignition coil, the second voltage applying means and the second voltage dividing means are housed within the case. The misfire detecting device is of the type for use in a distributorless type ignition system having a plurality of ignition coils. The plurality of ignition coils and the various means of the misfire detecting device are all housed within a single case. Accordingly, though a design alteration of the ignition coil is necessitated, the accuracy of detection of misfire, and the reliability and the maintenance ability of the device can be improved. Further, since the high voltage pulse producing means and the misfire detecting means can be used commonly, it becomes possible to reduce the number of constituent parts and the cost.

According to a further aspect of the present invention, the voltage dividing means of the above described other kind of misfire detecting device comprises a capacitor voltage dividing circuit including a capacitor of a small capacity connected at one end thereof to the reverse current preventing diode and a capacitor of a relatively large capacity grounded at one end and connected in series to the capacitor of a small capacity. By this misfire detecting device, the voltage at the spark plug side terminal of the reverse current preventing diode can be held within an allowable input range of the misfire detecting device.

The above structure is free from the above noted problems inherent in the prior art device.

It is accordingly an object of the present invention to provide a novel and improved misfire detecting device for a multi-cylinder internal combustion engine which can effect accurate detection at all times without being affected by the environment in which it is used and is highly reliable in operation.

DETAILED DESCRIPTION OF THE PREFERRED EMBODIMENTS

Figure 1:
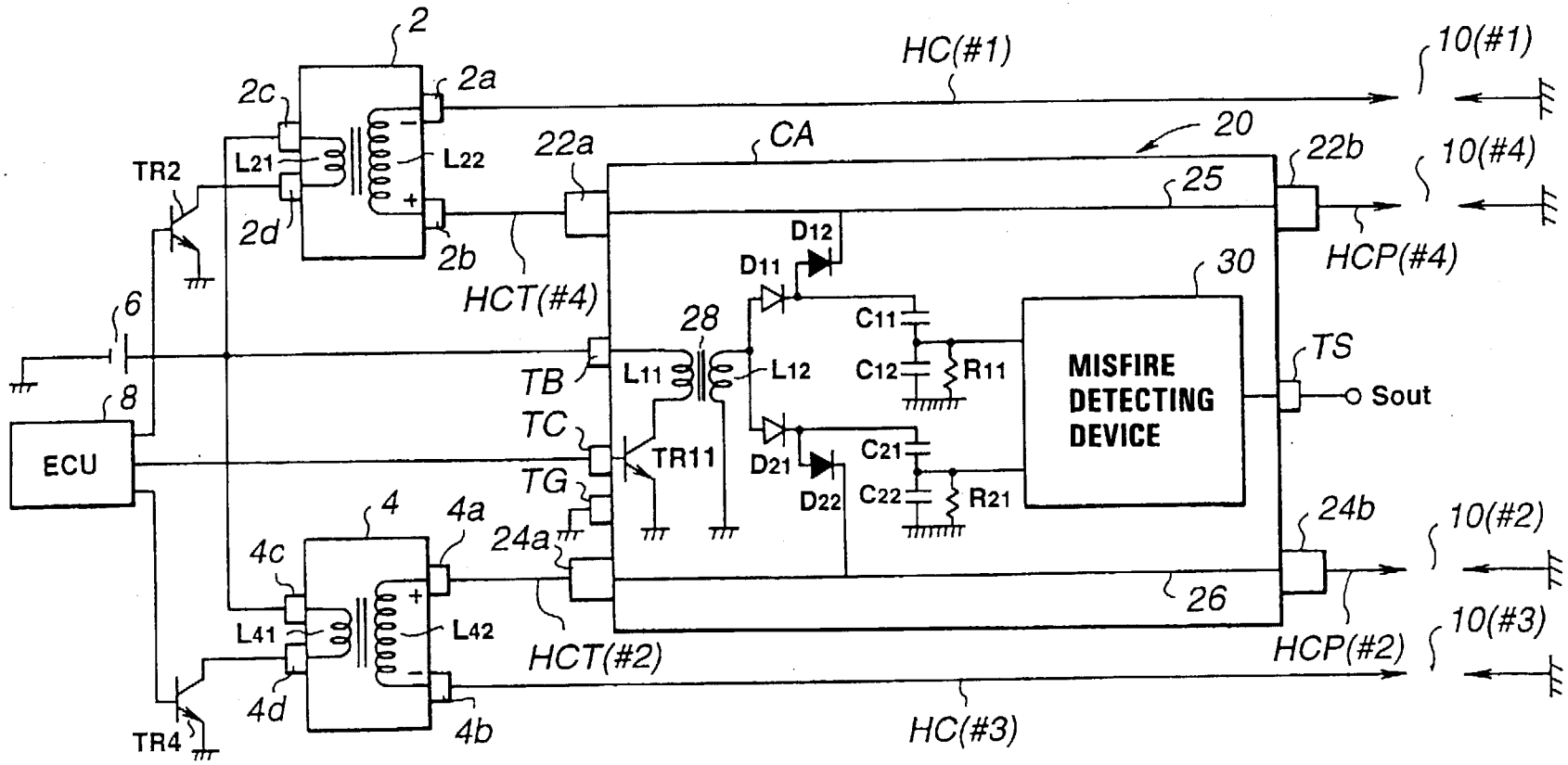
FIG. 1 is a circuit diagram of a double-ended distributorless ignition system having incorporated therein a misfire detecting device which is housed in a single case, according to an embodiment of the present invention.

In order to solve the above noted problems inherent in the prior device, it has been proposed a misfire detecting device which is constructed so as to apply a high voltage pulse which is not so high as to cause a spark plug to perform spark discharge, by way of a reverse current preventing diode and a leakage preventing diode for preventing intrusion of a high voltage for ignition or by way of a reverse current preventing diode and a secondary winding of an ignition coil, to a conductive path (i.e., high tension code) connecting between the secondary winding of the ignition coil and the spark plug, divide the voltage at the conductive path side of the reverse current preventing diode, and detect a combustion condition or misfire of each cylinder on the basis of the decay characteristic of the divided voltage, as disclosed in Japanese patent application Nos. 6-205834 and 6-198848 which are assigned to the same assignee of the subject application.

That is, the proposed device is adapted to utilize the fact that when a high voltage pulse is applied by way of a reverse current preventing diode to an ignition system of each cylinder of an internal combustion engine after spark discharge, for thereby storing a charge in the ignition system, the stored charge is discharged by means of ions existing adjacent to the electrodes of the spark plug having caused combustion, causing the terminal voltage at the reverse current preventing diode to decay, and thereby to detect whether the quantity of the ions existing adjacent the electrodes of the spark plug is large or small.

In a distributor type or a single-ended distributorless ignition system, the proposed device can be constructed so that, for example, a high voltage pulse from the reverse current preventing diode is applied by way of the secondary winding of the ignition coil to the spark plug of each cylinder to detect the voltage at the ignition coil side of the reverse current preventing diode by means of one voltage dividing circuit, whereby it becomes possible to detect a misfire at each cylinder, and the structure can be simplified to reduce the cost.

On the other hand, in a double-ended distributorless ignition system, the proposed device can be constructed so that a high voltage pulse is applied by way of a reverse current preventing diode and a leakage preventing diode to a conductive path connecting between the ignition coil and one spark plug to detect a voltage at the junction between the reverse current preventing diode and the leakage preventing diode by means of a voltage dividing circuit, it becomes possible to detect a combustion condition or misfire at a pair of spark plugs by one voltage dividing circuit, so that it becomes possible to simplify the structure and reduce the cost and furthermore it becomes possible to detect the combustion condition or misfire correctly without being affected by the polarity of a high voltage for ignition.

In the meantime, in the above proposed device, it was revealed that since, in order to apply a high voltage pulse from the reverse current preventing diode to the igniting line for each cylinder, a conductive harness was used to connect therebetween, there happened a case in which a combustion condition or misfire could not be detected correctly due to a variation of environment or circumstance. Hereinafter, the reason why will be described.

In the above proposed device, a charge is stored in the igniting line for each cylinder by way of the reverse current preventing diode, and a combustion condition or misfire is detected depending on the decay characteristic of a divided voltage which decays when the stored charge is discharged by means of the ions adjacent to the spark plug. The decay characteristic of the divided voltage varies depending upon a variation of a time constant which is determined by an interelectrode resistance of the spark plug and a capacitance of an igniting line including a charging path extending from the misfire detecting device to the igniting line. Accordingly, in the case where a conductive harness is used for applying a high voltage pulse from the reverse current preventing diode to the igniting line, also the capacitance-to-ground of the conductive harness has an influence on the decay characteristic of the divided voltage.

On the other hand, the capacitance-to-ground of the conductive harness varies under the influence of the water attached to the circumferential periphery of the harness due to dew condensation, etc. For example, in the case where the circumferential periphery of the conductive harness is completely wetted due to dew condensation, etc., the capacitance-to-ground of the harness becomes ten times larger than that obtained when it is dry. Also, as the capacitance-to-ground of the conductive harness increases, the time constant of the path extending from the reverse current preventing diode to the spark plug is caused to increase. In this instance, even if the amount of ions adjacent to the electrodes of the spark plug is constant, i.e., even if the interelectrode resistance of the spark plug is constant, the voltage obtained by the voltage dividing circuit changes gradually.

As a result, in the case where a high voltage pulse is applied from a reverse current preventing diode to an igniting line by way of a conductive harness, the anti-grounding characteristic of the conductive harness is liable to change much more depending upon a variation of environment as the conductive harness becomes longer, thus deteriorating the accuracy on detection of a combustion condition or misfire. Further, in the case where the conductive harness is not provided with a measure to counter noise as the high tension code but a simple covered wire with a vinyl covering, application of a high voltage causes a strong electromagnetic wave to radiate from the conductive harness, thus being causative of radio interference noise.

Further, though the high voltage pulse is low as compared with the high voltage for ignition, it needs to be as large as 1 kilovolt or so. In the case where a high voltage pulse is applied to the igniting line by way of a conductive harness as described above, it is considered that the conductive harness may possibly leak current to the outside, thus lowering the reliability. Further, in the case of disruption of the reverse current preventing diode, the leakage preventing diode or the like, a high voltage for ignition is applied to the conductive harness so it is considered that arc discharge from the conductive harness may possibly be caused. Further, even if the reverse current preventing diode and the leakage preventing diode are in good order, it is considered that the connector between the conductive harness and the voltage dividing circuit is disconnected or the conductive harness is broken or disconnected to cause corona discharge at the connector or at the broken or disconnected wire portion. Accordingly, in the case where a high voltage pulse is applied to the igniting line by way of the conductive harness, it is necessary to consider a countermeasure to discharge from the conductive harness and the connector, etc., thus causing a problem of a complicated structure and a high cost.

Referring first to FIG. 1, a misfire detecting device according to an embodiment of the present invention will be described. The misfire detecting device is applied to a double-ended distirbutorless ignition system for a four-cylinder internal combustion engine.

As shown in FIG. 1, the ignition system is provided with ignition coils 2 and 4 for applying, of spark plugs 10(#1)

~10(#4) provided to respective cylinders #1~#4, a high voltage for ignition (tens of kilovolts) to a pair of spark plugs 10(#1) and 10(#4) and another pair of spark plugs 10(#2) and 10(#3) simultaneously and in sequence, either of the pair of spark plugs of which are to discharge every one revolution of the internal combustion engine.

The ignition coils 2 and 4 are composed of primary windings L21 and L41 and secondary windings L22 and L42 which are wound one upon another and housed within cases filled with resin, respectively. On the upper surfaces of the cases, there are disposed secondary terminals 2*a* and 2*b*, 4*a* and 4*b* connected to the opposite ends of the secondary windings L22 and L42, respectively, and primary windings 2*c* and 2*d*, 4*c* and 4*d* connected to the opposite ends of the primary windings L21 and L41, respectively. Also, one primary terminal 2*c* and 4*c* of the ignition coils 2 and 4 are each connected to the positive side of a battery 6 which is grounded at the negative side, and another primary terminal 2*d* and 4*d* are each grounded by way of power transistors TR2 and TR4 which are turned on or off in response to an ignition signal from an engine control unit (ECU) 8.

On the other hand, the secondary terminals 2*a*, 2*b*, 4*a* and 4*b* of the ignition coils 2 and 4 are connected to the center electrodes of the spark plugs 10(#1)~10(#4) for the cylinders #1~#4. In the meantime, the outer electrodes of the spark plugs 10(#1)~10(#4) are grounded.

Further, high tension codes HC(#4), HC(#2) connecting, of the secondary terminals 2*a*, 2*b*, 4*a* and 4*b* of the ignition coils 2 and 4, the positive side secondary terminals 2*b* and 4*a* which receives a positive high voltage from the secondary windings L22 and L42 when the transistors TR2 and TR4 are turned off, and the spark plugs 10(#4) and 10(#2), are respectively divided to two sections, i.e., ignition coil side code sections HCT(#4) and HCT(#2), and spark plug side code sections HCP(#4) and HCP(#2). The divided ends of the codes sections HCT(#4), HCT(#2), HCP(#4) and HCP(#2) are connected to high voltage terminals 22*a*, 24*a*, 22*b* and 24*b* which are provided to a case CA of a combustion condition detecting circuit 20 in such a manner as to protrude outward therefrom. Further, within the case CA, there are accommodated conductive wires 25 and 26 which are connected with the high voltage terminals 22*a* and 22*b*, 24*a* and 24*b*, respectively.

Accordingly, the positive side secondary terminal 2*b* of the ignition coil 2 and the center electrode of the spark plug 10(#4) are connected by way of an ignition coil side code HCT(#4), the high voltage terminal 22*a*, a conductive wire 25, the high voltage terminal 22*b*, and a spark plug side code HCP(#4), whilst the positive side secondary terminal 4*a* of the ignition coil 4 and the center electrode of the spark plug 10(#2) are connected by way of an ignition coil side code HCT(#2), the high voltage terminal 24*a*, a conductive wire 26, the high voltage terminal 24*b* and a spark plug side code HCP(#2).

Within the case CA, there is disposed a coil 28 for producing a high voltage pulse. One end of a primary winding L11 of the coil 28 is connected to the positive side of the battery 6 by way of a battery voltage input terminal TB formed on the case CA, whilst the other end is grounded by way of the power transistor TR11. The power transistor TR11 is turned on or off when it receives a control signal from the engine control unit(ECU) 8 by way of a control signal input terminal TC formed on the case CA. Further, one end of a secondary winding L12, which is positioned on the side where a positive voltage is induced when the power transistor TR11 is turned off, is connected to the conductive wires 25 and 26 by way of reverse current preventing diodes D11 and D21 and leakage preventing diodes D12 and D22, whereas the other end of the secondary winding L12 is grounded.

Accordingly, the power transistor TR11 is turned on or off in response to a control signal produced by the engine control unit (ECU) 8, and at the time of its turning off a high voltage is induced in the secondary winding L12 of the coil 28 and applied as a positive high voltage pulse (of about 3 kilovolts in this embodiment) to the conductive wires 25 and 26. That is, in this embodiment, a high voltage pulse producing means is constituted by the coil 28 and the power transistor TR11, a voltage applying means is constituted by the reverse current preventing diodes D11 and D21 and the leakage preventing diodes D12 and D22, and those sections are housed within the case CA.

Further, within the case CA, there is housed a capacitor voltage dividing circuit (corresponding to a voltage dividing means) which includes series circuits made up of capacitors C11 and C21 of a small capacity and capacitors C12 and C22 of a large capacity, which are connected at one ends to the conductive wire 25, 26 side ends (i.e., cathodes) of the reverse current preventing diodes D11 and D21 and grounded at other ends, and resistors R11 and R21 of high resistance (for example, 10 MΩ) connected in parallel to the ground side capacitors of the series circuits, i.e., capacitors C12 and C22 of a large capacity, and a detecting circuit 30 (corresponding to a combustion condition detecting means) inputting the voltages at the junctions between the capacitors C11 and C21 of a small capacity and the capacitors C12 and C22 of a large capacity (i.e., a divided voltage) and detecting a combustion condition or misfire of each cylinder #1~#4 after spark discharge on the basis of a decay characteristic of the divided voltage.

In the meantime, a capacitor of an electrostatic capacity of about 5 picofarads is employed for the capacitors C11 and C21 of a small capacity, whereas a capacitor of an electrostatic capacity of about 2500~5000 picofarads is employed for the capacitors C12 and C22 of a large capacity. Further, the case CA is provided with a grounding terminal TG for grounding the above described internal circuit and an output terminal TS for outputting a detection signal Sout from the detection circuit 30 to the outside.

In the above described misfire detecting device of this embodiment, the power transistors TR11 is turned off by the signal produced by the engine control unit (ECU) 8 after firing of each cylinder #1~#4. Thereupon, a high voltage is induced in the secondary winding L12 of the ignition coil 28 as described above, and this high voltage is applied as a high voltage pulse to the respective conductive wires 25 and 26 by way of the reverse current preventing diodes D11 and D21 and the leakage preventing diodes D12 and D22. As a result, a charge is stored in the floating capacity of the high tension codes HC(#1)~HC(#4) and the conductive wires 25 and 26, which extend from the secondary windings L22 and L42 of the ignition coils 2 and 4 to the spark plugs 10(#1)~10(#4), the leakage preventing diodes D12 and D22 connecting between the reverse current preventing diodes D11 and D21 and the conductive wires 25 and 26, and the capacitor series circuits constituting the voltage dividing means.

On the other hand, since the stored charge is discharged at the electrodes of a spark plug after spark discharge, either of two kinds of divided voltages inputted to the detecting circuit 30 (i.e., the divided voltage on the spark plug side whose spark plug is provided to a cylinder having just finished firing), decays rapidly in the case where normal combustion takes place in the cylinder after spark discharge. However, in the case where normal combustion has not taken place in the cylinder after spark discharge due to a misfire, etc., either of the divided voltages does not decay rapidly. Thus, the detection circuit 30 determines a combustion condition of each cylinder on the basis of the decay characteristic of the divided voltage and outputs a detection signal Sout indicating a misfire when the decay of the divided voltage is slower than a predetermined value.

In the meantime, the leakage preventing diodes D12 and D22 prevent the high voltage for ignition produced by the ignition coils 2 and 4 from being inputted to the detecting circuit side to disrupt the detecting circuit, etc.

Further, in this embodiment, by applying a high voltage pulse to the igniting line extending from the ignition coils 2 and 4 to the spark plugs 10(#1)~10(#4), a charge is stored in the floating capacities of the igniting lines, and judgment on the discharging speed of the stored charge is made on the basis of the divided voltage for thereby detecting a misfire. For this reason, when the floating capacity of the conductive path to which a high voltage pulse is applied varies, the decay characteristic of the divided voltage is caused to vary, thus disabling accurate detection of a misfire. However, in this embodiment, the above described circuit sections constituting the misfire detecting circuit 20 is housed within the case CA, and application of a high voltage pulse is made within the case CA and directly to the conductive wires 25 and 26 connected in series to the high tension codes such that the path for application of the high voltage pulse can be considerably short and it becomes possible to prevent the capacity-to-ground of that path from being varied depending upon a variation of the environment in which it is used. Accordingly, by this embodiment, accurate detection of a misfire of each cylinder #1~#4 can be attained.

Further, the misfire detecting device 20 is all housed within a single case CA and can be attached to the igniting line by only connecting the high voltage terminals 22*a* and 24*a*, 22*b* and 24*b* formed on the case CA to the ignition coil side codes HCT(#4) and HCT(#2) and the spark plug side codes HCP(#4) and HCP(#2), respectively, so its attachment can be done with ease. Further, in the case of inspection and repairing, the case CA can be detached by only detaching the case CA from those codes, thus making it possible to improve the maintenance ability. Further, since the misfire detecting device 20 does not require any design alteration or modification, it becomes possible to increase the design freedom of the igniting line and the misfire detecting device. Further, since the misfire detecting device 20 is accommodated within a single case CA, such a fault as disconnection of a connecting portion and disruption of a diode is hard to occur, and even if such a fault occurs discharge to the outside of the case CA can be prevented, thus making it possible to improve the reliability.

Figure 2:
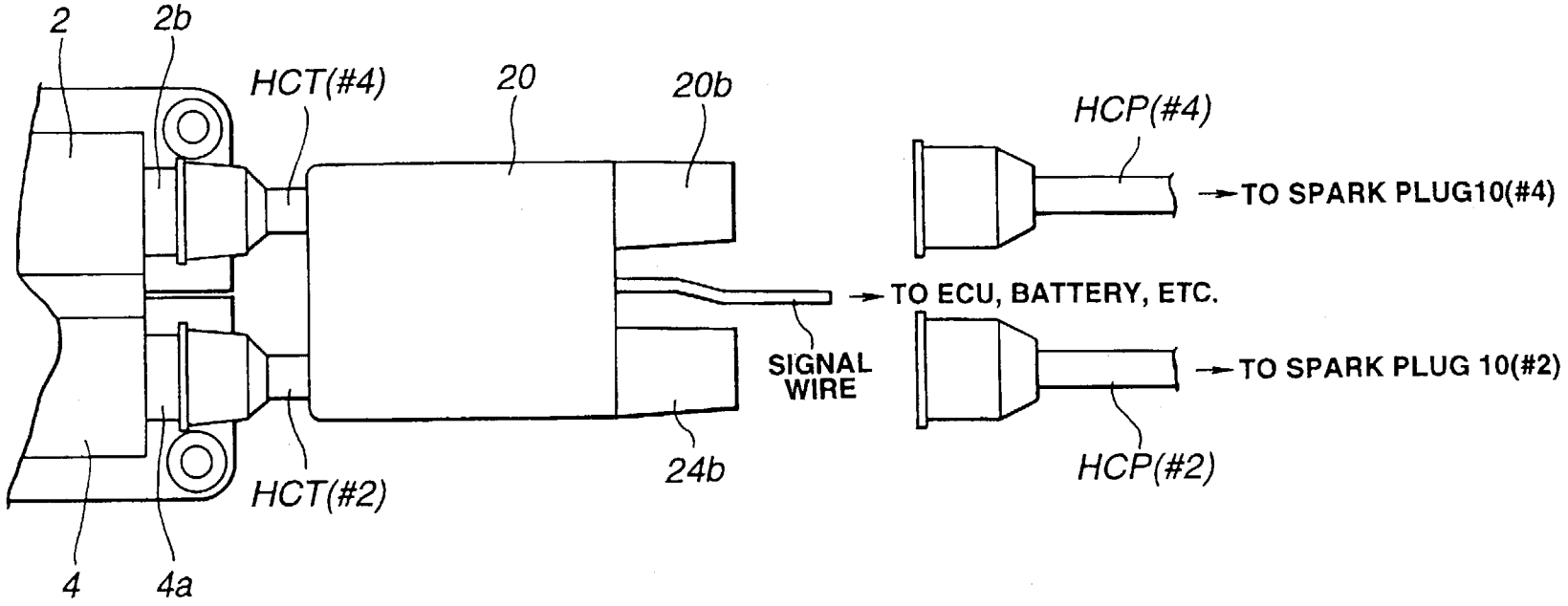
FIG. 2 is an illustration of how to connect a misfire detecting device of FIG. 1 to another device such as an ignition coil.

While this embodiment has been described and shown as being structured so that the high voltage terminals 22*a* and 24*a*, 22*b* and 24*b* for connection with the high tension codes, and the terminals TB, TG, TC and TS for supply of power, input of control signals and output of detection signal are formed on the case CA, this is not for the purpose of limitation. In the case where those terminals are formed separately on the case CA, a difficult work for connecting the misfire detecting device 20 to a corresponding device such as an ignition coil, etc. is necessitated when the misfire detecting device 20 is actually disposed or installed in an automotive engine compartment. For this reason, construction can be made, for example, as shown in FIG. 2, i.e., the ignition coil side codes HCT(#4) and HCT(#2) and signal wires for supply of power, input of control signals and output of detection signal can be extended to the outside of the misfire detecting device 20 so as to be connected to the positive side secondary terminals 2*b* and 4*a* of the ignition coils 2 and 4, the engine control unit (ECU) 8, etc. by way of connectors attached to the leading ends thereof.

Figure 4A:
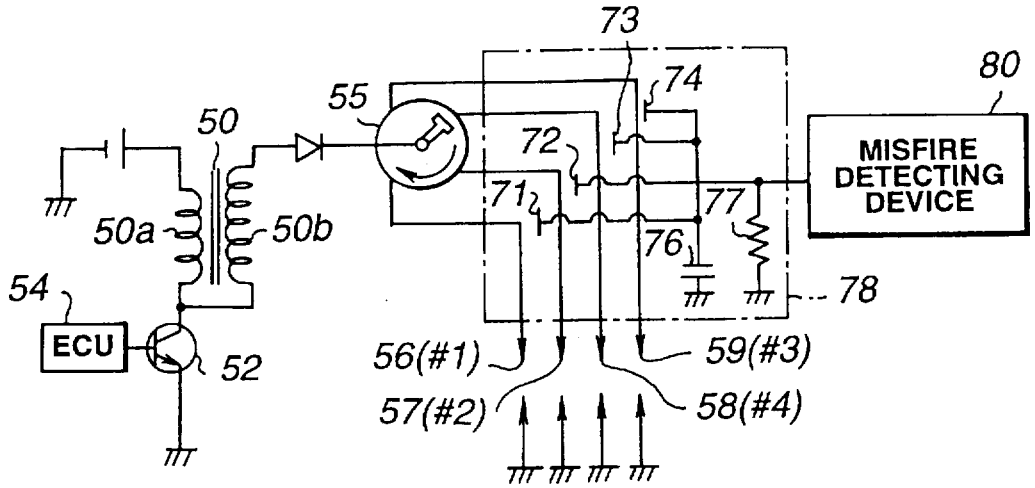
FIG.4A (PRIOR ART)
FIGS. 4A and 4B are circuit diagrams of a prior art distributor type ignition system and a prior art single-ended distributorless ignition system, respectively.
Figure 4B:
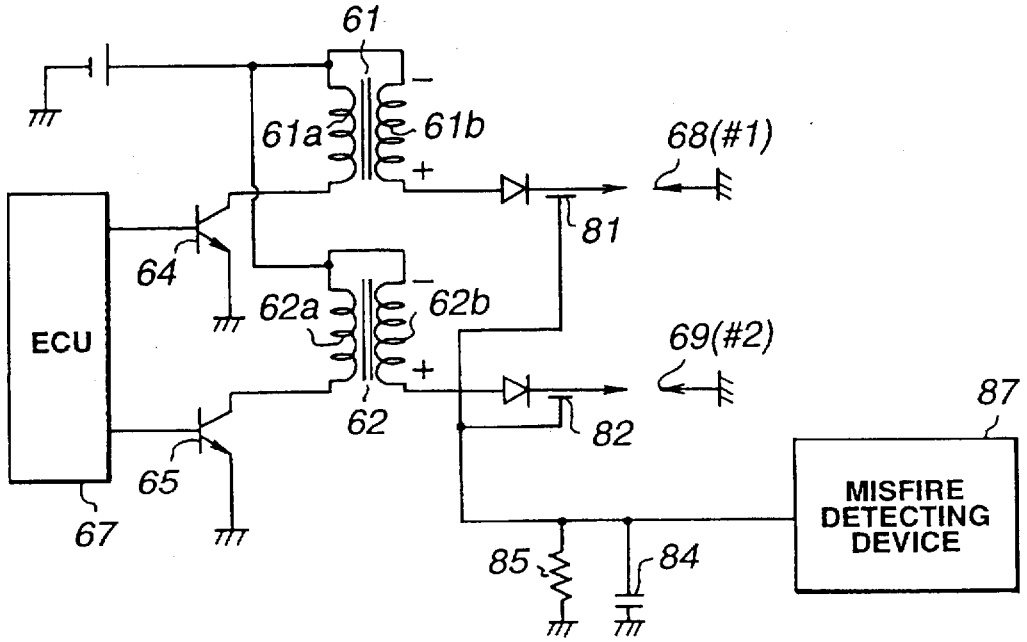
FIG.4B (PRIOR ART)

Further, while this embodiment has been described and shown as being applied to a double-ended distributorless ignition system, this is not for the purpose of limitation. For example, it can be applied to a distributor type ignition system such as shown in FIG. 4A or a single-ended distributorless ignition system to produce the same effect as the above described embodiment, by dividing, as in the above described embodiment, the high tension code of each spark plug into two sections, and installing the misfire detecting device in the case CA having the high voltage terminals capable of connecting between the ignition coil side codes and the spark plug side codes, and conductive wires connecting between those high voltage terminals.

Figure 3:
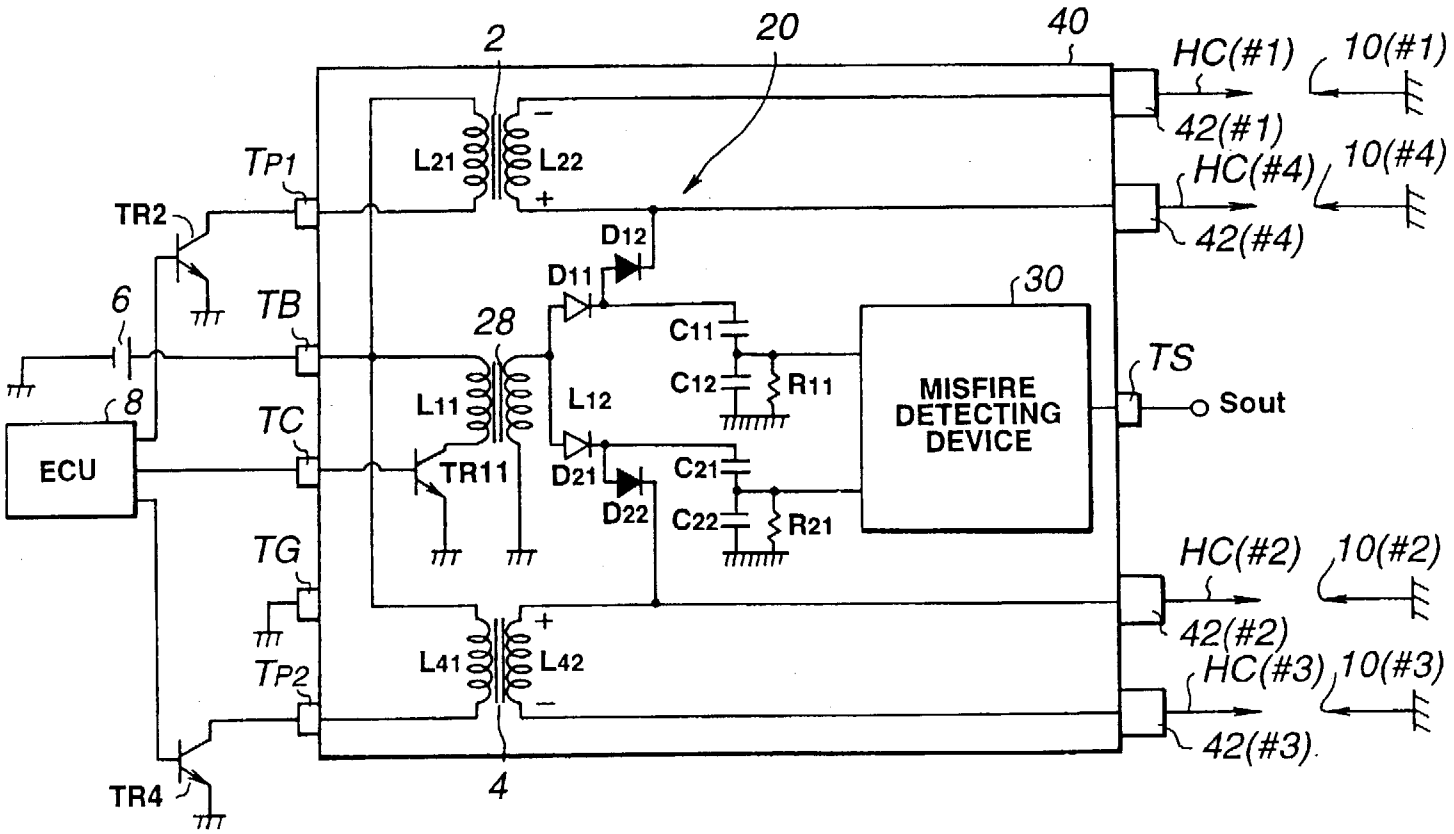
FIG. 3 is a circuit diagram of a double-ended distributorless ignition system having incorporated therein a misfire detecting device housed together with an ignition coil within the same case.

Further, while the present invention has been described and shown as being such that only the combustion condition detecting device is housed within the case CA, the ignition coils 2 and 4 and the combustion condition detecting device 20 can all be installed within a case 40 as shown in FIG. 3.

FIG. 3 shows an embodiment in which the misfire detecting device 20 for a double-ended disributorless ignition system, which is structured similarly to the previous embodiment of FIG. 1, is housed within the case 40 together with the ignition coils 2 and 4. This embodiment differs from the previous embodiment of FIG. 1 in that the case 40 is provided with high voltage terminals 42(#1)~42(#4) for supplying a high voltage for ignition and a high voltage pulse to the spark plugs for each cylinders #1~#4 by way of high tension codes HC(#1)~HC(#4) and ignition control terminals TP1 and TP2 for connection between the primary windings L21 and L41 of the ignition coils 2 and 4 and the power transistors TR2 and TR4, and the internal circuit thereof is exactly the same as the previous embodiment so that the explanation thereto is omitted for brevity.

In such a case, though conventional ignition coils cannot be used in their original forms as they stand but require design alterations, it can effect improvements in the detection accuracy, the reliability of the device and the maintenance ability and in addition thereto can make the igniting line more compact in size and light in weight and perform an assembly work for installation of the device into the engine compartment more easily.

Further, in the case where the ignition coils and the misfire detecting device are housed within a single case and the ignition system is of the type for use in a distributor type or single-ended distributorless ignition system, a high voltage pulse can be applied to one end side of the secondary winding of the ignition coil, which is not connected with a spark plug. In this instance, a leakage preventing diode is not necessitated, which is otherwise necessary in the case where a high voltage pulse is applied directly to a high tension code, thus making it possible to reduce the number of parts of the circuit for detection of misfire.

Further, particularly in the case of a distributor type ignition system, only one conductive path is provided to connect between the ignition coil and the distributor, so that judgment on a misfire of each cylinder can be made by applying a high voltage pulse to the conductive path and detecting a voltage variation. Thus, a misfire detecting circuit integrated with the ignition coil can be for only one cylinder, thus making it possible to simplify the structure and reduce the cost.

What is claimed is:

1. A misfire detecting device for a multi-cylinder internal combustion engine having an ignition system for interrupting flow of primary current through a primary winding of an ignition coil and thereby inducing a high voltage for ignition in a secondary winding, and applying the high voltage for ignition to a spark plug provided to each cylinder of the multi-cylinder internal combustion engine, the misfire detecting device comprising:

high voltage pulse producing means for producing, after spark discharge of the spark plug, a high voltage pulse which is not so high as to cause the spark plug to discharge;

voltage applying means for applying said high voltage pulse to a conductive path connecting between the secondary winding of the ignition coil and the spark plug, by way of a reverse current preventing diode and a leakage preventing diode for preventing intrusion of the high voltage for ignition;

voltage dividing means for dividing a voltage at the junction between said reverse current preventing diode and said leakage preventing diode to obtain a divided voltage thereat; and misfire detecting means for detecting a misfire on the basis of a decay characteristic of said divided voltage obtained after application of said high voltage pulse;

wherein said high voltage pulse producing means, said voltage applying means, said voltage dividing means and said misfire detecting means are housed within a case having a pair of terminals connectable directly and in series to said conductive path and having disposed therewithin a conductive line connecting between said terminals, and said voltage applying means applies said high voltage pulse to said conductive line.

2. A misfire detecting device for a multi-cylinder internal combustion engine according to claim 1, further comprising second voltage applying means for applying said high voltage pulse to a second conductive path connecting between a secondary winding of a second ignition coil and another spark plug of the engine, by way of a second reverse current preventing diode and a second leakage preventing diode for preventing intrusion of the high voltage for ignition, and second voltage dividing means for dividing a voltage at the junction between said second reverse current preventing diode and said second leakage preventing diode to obtain a second divided voltage thereat, said misfire detecting means being operative to detect a misfire on the basis of a decay characteristic of said second divided voltage after application of said high voltage pulse, said case having a second pair of terminals connectable directly and in series to said second conductive path and having disposed therewithin a second conductive line connecting between said second pair of terminals, said second voltage applying means and said second voltage dividing means being housed within said case.

3. A misfire detecting device for a multi-cylinder internal combustion engine according to claim 1, wherein said voltage dividing means comprises a capacitor voltage dividing circuit including a capacitor of a small capacity connected at one end thereof to said reverse current preventing diode and a capacitor of a small capacity connected at one end thereof to said reverse current preventing diode and a capacitor of a relatively large capacity grounded at one end and connected in series to said capacitor of a small capacity.

4. A misfire detecting device for a multi-cylinder internal combustion engine having an ignition system for interrupting flow of primary current through a primary winding of an ignition coil and thereby inducing a high voltage for ignition in a secondary winding, and applying the high voltage for ignition to a spark plug provided to each cylinder of the multi-cylinder internal combustion engine, the misfire detecting device comprising:

high voltage pulse producing means for producing, after spark discharge of the spark plug, a high voltage pulse which is not so high as to cause the spark plug to discharge;

voltage applying means for applying said high voltage pulse to a conductive path connecting between the secondary winding of the ignition coil and the spark plug, by way of one of a first path having a reverse current preventing diode and a leakage preventing diode for preventing intrusion of the high voltage for ignition and a second path having said reverse preventing diode and the secondary winding of the ignition coil;

voltage dividing means for dividing a voltage at the junction between said reverse current preventing diode and said leakage preventing diode to obtain a divided voltage thereat; and misfire detecting means for detecting a misfire on the basis of a decay characteristic of said divided voltage obtained after application of said high voltage pulse;

wherein said high voltage pulse producing means, said voltage applying means, said voltage dividing means and said misfire detecting means are housed within a case for the ignition coil.

5. A misfire detecting device for a multi-cylinder internal combustion engine according to claim 4, wherein the ignition system is a distributorless type and further has a second ignition coil, the misfire detecting device further comprising second voltage applying means for applying said high voltage pulse to a second conductive path connecting between a secondary winding of the second ignition coil and another spark plug of the engine, by way of one of a first path having a second reverse current preventing diode and a second leakage preventing diode for preventing intrusion of the high voltage for ignition and a second path having said second reverse current preventing diode and the secondary winding of the second ignition coil, and second voltage dividing means for dividing a voltage at the junction between said second reverse current preventing diode and said second leakage preventing diode to obtain a second divided voltage thereat, said misfire detecting means being operative to detect a misfire on the basis of a decay characteristic of said second divided voltage after application of said high voltage pulse, the second ignition coil, said second voltage applying means and said second voltage dividing means being housed within said case.

6. A misfire detecting device for a multi-cylinder internal combustion engine according to claim 4, wherein said voltage dividing means comprises a capacitor voltage dividing circuit including a capacitor of a small capacity connected at one end thereof to said reverse current preventing diode and a capacitor of a relatively large capacity grounded at one end and connected in series to said capacitor of a small capacity.

* * * * *